United States Patent [19]

Booz

[11] 4,065,060

[45] Dec. 27, 1977

[54] METAL FLAKE PRODUCTION

[75] Inventor: A. David Booz, New Kensington, Pa.

[73] Assignee: Aluminum Company of America, Pittsburgh, Pa.

[21] Appl. No.: 730,181

[22] Filed: Oct. 6, 1976

[51] Int. Cl.[2] ..... B02C 23/10

[52] U.S. Cl. ..... 241/16; 241/30; 241/79.2; 241/171

[58] Field of Search ..... 241/15, 16, 20, 24, 241/30, 38, 61, 62, 79, 79.2, 170, 171, 176, 184

[56] References Cited

U.S. PATENT DOCUMENTS

| | | | |
|---|---|---|---|
| 2,002,891 | 5/1935 | Hall | 241/15 |
| 2,139,358 | 12/1938 | Ericson | 241/79 |
| 2,274,766 | 3/1942 | Ziehl | 241/16 |
| 2,332,701 | 10/1943 | Dowsett | 241/171 |
| 2,592,783 | 4/1952 | Aspegren | 241/184 |
| 3,709,439 | 1/1973 | Tundermann et al. | 241/15 |

*Primary Examiner*—Granville Y. Custer, Jr.
*Attorney, Agent, or Firm*—Andrew Alexander

[57] ABSTRACT

Metal flake is formed by charging metal particles, liquid and milling material to a ball mill. Metal flake formed, liquid and milling material are removed from the mill at a rate commensurate with the charging rate. The flake is then separated from the milling material.

17 Claims, 2 Drawing Figures

FIG. 1.
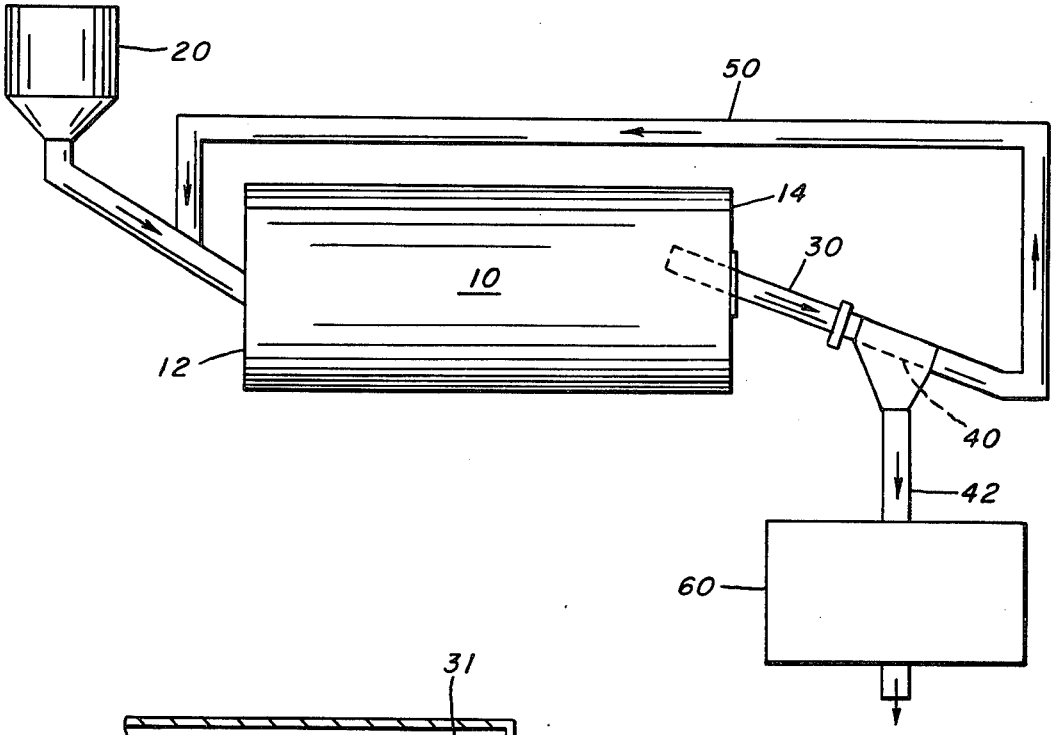
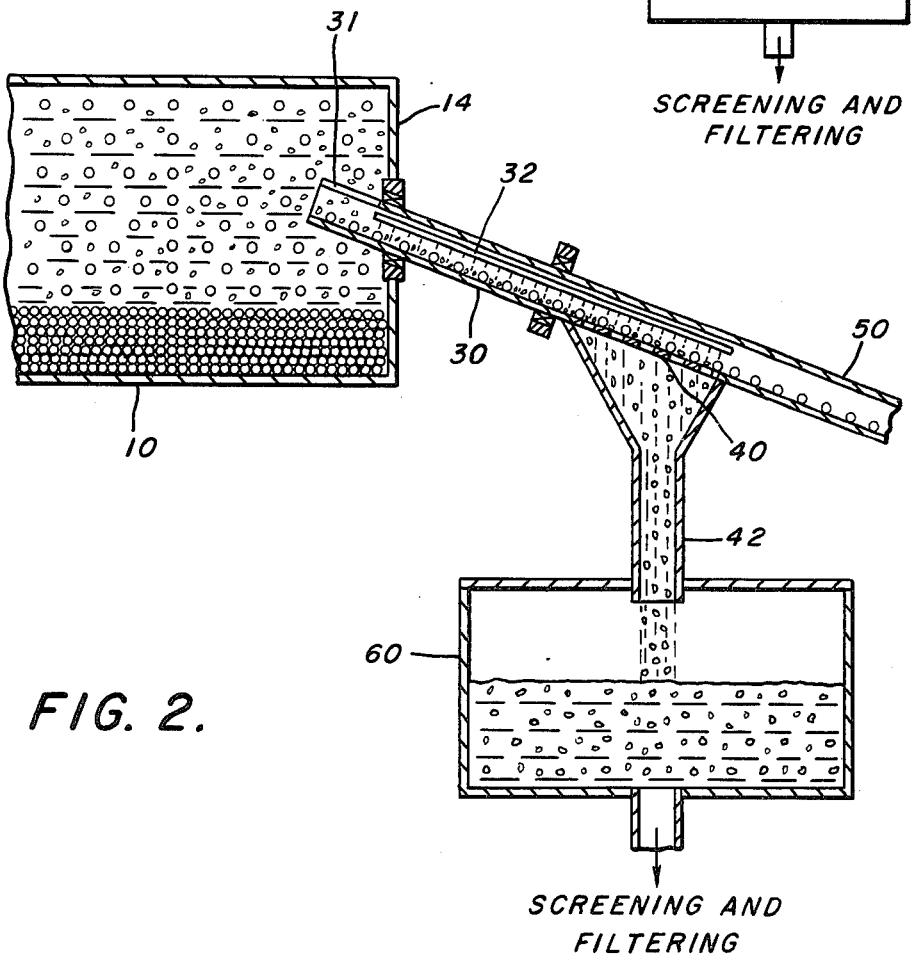
FIG. 2.

METAL FLAKE PRODUCTION

This invention relates to production of metal flake and more particularly it relates to a method and apparatus for the production of metal flake from metal particles.

In the prior art, metal flake has been produced in a ball mill or grinding mill or the like wherein the balls or grinding media are retained within the mill and the raw materials are added and the finished product removed. The raw materials may be added periodically or may be added substantially continuously. In the former, the finished product, i.e. the ground material, is generally removed batchwise. In the case where the raw materals are added continuously, the finished product may be removed continuously by operations which include grate discharge, trunnion overflow and air sweep or the like as shown in Ball, Tube and Rod Mills, H. E. Rose and R. M. E. Sullivan, 1958, pp. 22–23. However, these continuous systems for grinding have serious deficiencies. For example, it has been found over the years that most efficient grinding or milling to produce metal flake, particularly in wet grinding, requires that the metal particles or powder should comprise 45 to 55 wt.% of the raw materials charged to the mill. However, having a charge containing this amount of metal normally results in having great difficulty in pumping or otherwise removing the ground material from the mill. Thus, for pumping or gravity flow purposes, normally the charge is diluted to contain only about 25 to 35 wt.% of the metal particles. However, this dilution effect retards the grinding or metal flake producing operation. Thus it can be seen that in using grate discharge or trunnion overflow methods a compromise is reached between efficient milling and transporting materials through the mill.

The present invention solves the problem encountered in using prior art type mills by providing a method and apparatus which permits metal flake production at optimum metal concentrations.

SUMMARY OF THE INVENTION

An object of this invention is the production of metal flake.

Another object of this invention is the production of metal flake in a wet mill grinding operation.

Yet another object of this invention is the continuous production of metal flake in a ball mill.

These and other objects will become apparent from the drawing, description and claims appended hereto.

In accordance with these objectives, a method of forming metal flake comprises charging metal particles, liquid and milling material to a ball mill, forming the metal flake therein and removing it and milling material from the mill at a rate commensurate with the charging rates. The flake is then separated from the milling material. An apparatus for producing metal flake in accordance with the process of the invention comprises a ball mill adapted to rotate about its longitudinal axis and means for supplying raw materials such as metal particles, milling material, lubricant and solvent to the mill. In addition, the apparatus comprises a discharge scoop suitable for removing metal flake and milling material at a controlled rate. Upon rotation of the mill, metal flake and milling material enter the scoop and are removed.

BRIEF DESCRIPTION OF THE DRAWINGS

FIG. 1 is a schematic of a grinding mill system in accordance with the invention.

FIG. 2 is a cross-sectional view of the grinding mill discharge scoop.

DETAILED DESCRIPTION OF THE PREFERRED EMBODIMENTS

In accordance with the invention, metal flake is formed by charging metal particles, liquid, e.g. milling lubricant and solvent, and milling material to a ball mill. After milling, metal flake formed, milling material and liquid are removed at a rate substantially commensurate with the charging rates. The flake is then separated from the milling material. In a preferred embodiment, the milling material, for example metal balls, are recirculated and introduced to the mill at a controlled rate. Apparatus suitable for the process includes a ball mill having a discharge scoop adapted to remove the metal flake and the milling material. The apparatus can also include means for separating the metal flake from the milling material and also means for recirculating the milling material to the mill.

Metal particles which can be worked or formed into metal flake include metal powder, chips, filings, borings and the like, the preferred particle form being metal powder. Metals which may be provided in this form and which can be formed into flake include aluminum, nickel, iron, stainless steel and alloys such as bronze and brass.

Milling lubricant useful in the present invention includes longer chain fatty acids such as stearic acid, lauric acid, oleic acid, behenic acid with stearic acid being preferred for reasons of economics and efficiency during milling. Other lubricants, including tallow, may be used depending largely on the type of flake desired.

When making aluminum flake from aluminum powder, a source of oxygen such as air can be added to the mill to control the reactivity of the aluminum flake surface. That is, air added to the mill reacts with the aluminum flake surface to form aluminum oxide, thereby lowering flake reactivity. Conversely, if it is desired to form a highly reactive aluminum flake surface, oxygen or air can be excluded from the mill by the use of an inert gas such as nitrogen, argon, helium and the like.

In the present invention it is preferred to add a solvent such as mineral spirits, particularly when metal flake, e.g. aluminum flake, is being formed. The mineral spirits solvent helps control dust and substantially eliminates problems arising therefrom. Also, the solvent aids in controlling uniformity of temperature throughout the mill by improving heat transfer. In addition, in the production of metal flake for use in paints, the use of solvents provides a pre-wetted flake which is more easily dispersed in the paint.

With respect to the milling material, it is preferred to use generally spherical metal balls since they act to provide highly efficient grinding. Further, it is preferred that the metal in such balls is steel. The balls useful in the present invention typically range in size from 3/16 inch to ⅜ inch in diameter although in certain cases smaller or larger balls may be used depending to some extent on the starting material.

In the process of the invention, the metal particles, milling lubricant and solvent can be added separately to the grinding mill. However, it is preferred that the metal particles and milling lubricant be mixed prior to being added to the mill. When the metal is aluminum, these materials are added to provide a mix in the mill comprising 35 to 65 wt.% metal particles, 0.4 to 7 wt.% lubricant, the remainder solvent. Preferably, the mix comprises 45 to 55 wt.% metal, 1.0 to 4.5 wt.% lubricant, the remainder solvent. This consistency is important in order that the mix has the desired viscosity when passing through the mill to provide maximum efficiency in grinding as mentioned hereinabove. Thus, it will be noted that while in the preferred embodiment, the present invention operates with a mix of 45 to 55 wt.% metal, e.g. aluminum, for the most efficient metal flake production, it is within the purview of the present invention to operate at lower or higher metal concentrations depending on the metal used.

Another important aspect of the present invention is the weight ratio of milling material, i.e. metal balls or spheres to metal particles present in the ball mill. In the present invention, this weight ratio can range from 18:1 to 60:1 with a preferred range being 20:1 to 40:1 when milling metal particles such as aluminum. Thus, while it is important to control the metal particle content in the mill as noted earlier, it is also important to add to the controlled metal particle concentration a controlled amount of milling material to obtain the maximum benefits of this invention.

Having the raw materials such as metal powder, milling lubricant, solvents and milling material controlled essentially as above permits the production of fine, medium or coarse flake by varying the residence time in the ball mill. In a continuous ball mill, the residence time is determined by the time required for the materials to move from the entrance to the exit of the mill. Because the mix in the present ball mill is quite viscous when compared to conventional continuous grinding operations, the movement of the materials through the mill approximates plug flow. That is, a given mass of ingredients required to produce flake moves from the entrance to the exit of the mill with substantially no backmixing or short-circuiting and the attendant problem of over or under grinding, i.e. producing excessive fines or excessive amounts of coarse particles. Thus, in the present mill, there is substantially controlled movement from the entrance to the exit of the mill. It will be appreciated that the time to move from entrance to exit, i.e. residency time, can vary from a few hours to a few days depending to some extent on the metal particle size and the amount of grinding required.

Movement of materials through the mill is controlled by flow of materials to or from the mill. That is, the residence time of the materials in the mill can be increased by decreasing the rate of flow or addition of feed to the mill and by decreasing the rate of removal of materials from the mill. Conversely, the residence time in the mill can be decreased by increasing the rate of flow or addition of feed to the mill and increasing the rate of removal of materials from the mill. Thus, it will be seen that particle size of the flake can be easily controlled by adjusting these rates. That is, the size of the flake can be decreased by increasing the residence time.

On reaching the exit of the mill, metal flake, milling lubricant, solvent and milling material are removed at a controlled rate. Upon removal, the milling material is separated from the other materials. This may be accomplished by diluting the mix to about 5 to 20 wt.% metal, and permitting flake, lubricant and solvent to pass through a screen which retains the milling material. After separation, the milling material may be returned or recirculated to the entrance of the mill for further use. The metal flake may be passed to a holding tank for purposes of subsequent screening and filtering.

With reference to FIG. 1, for the process of the present invention, there is shown a schematic of an apparatus comprising a ball mill 10 generally cylindrical or tubular in shape, a feed hopper 20, and a discharge scoop 30. A separator 40 is provided to separate metal flake from the balls as best seen in FIG. 2. A conduit 50 serves to return the balls to hopper 20 for recirculation through mill 10. Conduit 42 conveys metal flake and solvent to holding tank 60 from which the flake can be dispersed for screening and filtering. Thus, it can be seen that after the initial start-up of mill 10, raw material, e.g. metal powder, milling lubricant and solvent, along with steel balls, can be introduced at entrance end 12 of the mill and metal flake and steel balls removed at exit end 14 of mill 10 more or less continuously. That is, metal flake and milling material can be removed at a rate substantially commensurate with the charging rate.

Discharge scoop 30 is an important aspect of the system since it permits controlled removal of metal flake, lubricant, solvent and milling balls. Discharge scoop 30 may be constructed from a circular pipe or the like by providing a longitudinal slot 31 therein. The slotted pipe, preferably inclined from the horizontal at a slope in the range of 15° to 35°, should be mounted so as to be rotatable about its axis, permitting the size of the slot as seen by falling flake and balls during rotation of the mill to be adjusted. That is, the slotted opening can be adjusted by rotation of scoop 30 about its axis to increase or decrease the amount of flake and balls being caught or falling into it in the mill, thereby regulating the flow of materials from the mill.

It should be noted that when the mill of the present invention is operated or rotated at a certain speed, the materials will be lifted by the wall of the mill. At this certain speed, the balls and metal particles or metal flake will then tumble or drop onto balls and flake on the opposite side of the mill, producing metal flake in this way as well known in the art. It is during this process of tumbling or dropping that the balls, metal flake and liquid are preferably caught in scoop 30 and removed at a controlled rate.

As will be seen from FIG. 2, located within discharge scoop 30 is a spray means 32 to wash the steel balls free of metal flake. In this washing operation, solvent is added in an amount sufficient to make the flake easily pumpable or flowable. Preferably, when aluminum flake is being produced sufficient solvent is added during the spraying operation to lower the aluminum content to 5 to 25 wt.%. It should be noted that the spray aids the flow of flake and metal balls down the inclined slope of discharge scoop 30 to screen 40 where the flake is separated from the balls. The flake and solvent flow through conduit 42 to holding tank 60. The steel balls, after separation, can be continuously returned by any suitable means, such as a screw type elevator.

The apparatus of the present invention may be operated on the basis of an open circuit in which case large particles removed from the mill with the metal flake are screened out of the system. In addition, the apparatus may be operated on a closed circuit basis, in which case the large particles removed from the mill are screened out and continuously fed back to the mill at its entrance end. The large particles can be fed to the mill by means such as a screw feeder.

The gas referred to earlier is preferably provided so as to have parallel flow with the materials passing through the mill. That is, gas is preferably added at the entrance end of the mill and removed at the exit end. The gas can be added and removed by means well known to those skilled in the art.

The metal flake produced according to this invention can be employed in a vast number of paint, coating and ink formulations where their value as a pigment have long been established. More recently, as is known in the art, such products have been widely employed in various explosive and blasting formulations where they have great value as a booster fuel and serve to provide requisite sensitivity for initiation.

The present invention is advantageous since it improves both milling efficiency and overall productivity significantly. Another advantage resides in the fact that flake size can be adjusted by changing the feed and removal rates. Also, because of the controlled flow through the mill, flake size can be controlled, preventing the flake from permaturely reaching a limiting size. Also, because of the controlled flow through the mill, backmixing, which is undesirable since it results in excessive fines being generated, is kept to a minimum. The present system is also advantageous since it is not impeded with the high solvent content in order to be pumpable. That is, as noted earlier, metal particle content can be maximized for optimum milling.

The following examples are still further illustrative of the invention:

EXAMPLE 1

Aluminum flake was produced in accordance with the invention in a ball mill of about 3 feet in diameter and 8.5 feet long. For purposes of start-up the mill was charged initially with 5,421 pounds of steel balls about 5/16 inches in diameter. The mill was operated such that steel balls would be removed and recirculated at about 11.3 lbs./min. Alcoa grade 120 atomized aluminum powder containing 5 wt.% stearic acid was added at a feed rate of 29 lbs./hr. Mineral spirits was added to the mill at 4.5 gallons/hr. and air was passed through the mill at 5 SCFM. The mill was rotated at 44 rpm. After steady state conditions were obtained, an 8 hour residence time was used for milling purposes, steady state being obtained after about 3 residence periods. The feed rates established an aluminum metal particle concentration of about 50 wt.% and a ball to aluminum particle weight ratio of 23.4 to 1. Aluminum flake produced, balls and solvent were removed from the milling action and sprayed with mineral spirits substantially as shown in FIG. 2 to wash the balls free of the metal flake and to aid in separation of the balls from the flake. That is, the spray washed the flake from the balls and through a 10 mesh screen (U.S. series) which screen prevented the balls from passing. After separation, the balls were recirculated to the entrance end and fed into the mill. After passing through a 60 mesh screen (U.S. series) to ensure against the presence of large particles, aluminum flake produced had a median particle size of 13.6 microns, as measured by a Coulter counter.

EXAMPLE 2

Operating conditions were as in Example 1 except the feed rate of aluminum powder was 18.1 lbs./hr. and the ball to aluminum metal particle ratio was 27.4 to 1. The aluminum flake obtained had a median particle size of 11.3 microns.

EXAMPLE 3

Operating conditions were as in Example 2 except the feed rate of aluminum powder was 33.9 lbs./hr. and the ball to feed weight ratio was 20:1. The aluminum flake obtained had a median particle size of 16.3 microns.

EXAMPLE 4

Aluminum flake was produced in the ball mill of Example 1. In this instance, the mill was charged with 7,270 pounds of steel balls of about 5/16 diameter. The recirculation rate of the steel balls was 24.3 lbs./min. and feed rate of Alcoa grade 108 atomized powder containing 3 wt.% stearic acid was 56.7 lbs./hr. Mineral spirits feed rate was 7.1 gallons/hr. and air feed rate was 5 SCFM at a pressure of 5 psig. The average residence time was 5.0 hours. In this example, large particles were continuously removed and returned to the mill for further milling. Aluminum flake obtained during this process had a median particle size of 15.6 microns.

It will be seen from these examples that aluminum flake can be produced on a continuous basis, operating at an aluminum particle concentration of about 50 wt. %. However, the concentration can be changed as required. Also, the above examples show that the particle size can be controlled to the desired size by modification of the feed rates.

While the invention has been described in terms of preferred embodiments, the claims appended hereto are intended to encompass other embodiments which fall within the spirit of the invention.

Having thus described the invention and certain embodiments thereof, what is claimed is:

1. A method of forming metal flake from metal particles comprising:

a. charging a ball mill with milling media and with materials to provide a mix therein of said materials comprising approximately 35 to 65 wt.% metal particles, 0.4 to 7 wt.% lubricant, the remainder solvent;

b. operating the mill to form said metal flake;

c. removing a portion of the metal flake, liquid and milling material from the mill at a rate commensurate with said charging thereto; and d. separating the milling material from the liquid and metal flake by washing the milling material substantially free of said metal flake.

2. The method according to claim 1 wherein the milling media removed in step (c) is recirculated to said mill.

3. The method according to claim 1 wherein the milling media employed is metal balls.

4. The method according to claim 1 wherein the metal particles are aluminum particles.

5. The method according to claim 1 wherein the solvent is mineral spirits.

6. The method according to claim 1 wherein the weight ratio of milling material to metal particles is in the range of 18:1 to 60:1.

7. A method of forming metal flake from metal particles comprising:

a. charging a ball mill with milling media and with materials to provide a mix therein of said materials comprising approximately 35 to 65 wt.% metal particles, 0.4 to 7 wt.% lubricant, the remainder solvent;

b. operating the mill to form said metal flake;

c. removing a portion of the metal flake, liquid and milling material from the mill at a rate commensurate with said charging thereto; and d. separating the milling material from the liquid and metal flake by addition of solvent to provide a mix having a flake content in the range of 5 to 20 wt.%.

8. A method of forming aluminum flake from aluminum particles comprising:

a. charging aluminum particles, lubricant, solvent and metal balls to a ball mill to provide a mix therein having 35 to 65 wt.% aluminum, 0.4 to 7 wt.% lubricant, the remainder solvent, said metal balls to aluminum being present in a weight ratio in the range of 18:1 to 60:1;

b. operating said mill to form said aluminium flake;

c. removing a portion of the aluminum flake, lubricant, solvent and the metal balls from said mill at a rate commensurate with said charging thereto;

d. separating the metal balls in the removed portion from the aluminum flake, lubricant and solvent; and e. recirculating and feeding said metal balls to said mill at a rate substantially commensurate with their removal in step (c).

9. A method of forming metal flake from metal particles in a tubular shaped ball mill adapted to rotate about its longitudinal axis, the mill having an entrance end and an exit end, the method comprising:

a. charging a ball mill with metal balls and with materials to provide a mix therein of said materials comprising approximately 35 to 65 wt.% metal particles, 0.4 to 7 wt.% lubricant, the remainder solvent;

b. operating the mill to form said metal flake;

c. removing a portion of the metal flake, lubricant, solvent and metal balls at the exit end of the mill at a rate commensurate with said charging thereto, thereby controlling the residence time and consequently the metal flake size;

d. in the portion removed from the mill, separating the metal balls from the metal flake, lubricant and solvent by spraying with solvent to wash said balls substantially free of said metal flake; and e. recirculating and feeding the metal balls to the mill at its entrance end, the feeding rate being substantially commensurate with the rate of removal in step (c).

10. The method according to claim 9 wherein the metal particles are aluminum particles.

11. The method according to claim 10 wherein aluminum particles, lubricant and solvent are charged to provide a mix in the mill comprising 35 to 65 wt.% aluminum, 0.4 to 7 wt.% lubricant, the remainder solvent.

12. A method of forming aluminum flake from aluminum particles in a tubular shaped ball mill adapted to rotate about its longitudinal axis, the mill having an entrance end and an exit end, the method comprising:

a. providing a quantity of steel balls in the mill;

b. charging aluminum particles, lubricant, solvent at the entrance end of the mill at a controlled rate to provide a mix therein having 35 to 65 wt.% aluminum, 0.4 to 7 wt.% lubricant, the remainder solvent, the ratio of steel balls to aluminum being present in the mill in the weight ratio in the range of 18:1 to 60:1;

c. operating said mill to form the aluminum flake;

d. removing a portion of the aluminum flake, lubricant, solvent and metal balls from said mill at a rate commensurate with the charging thereto, thereby controlling the residence time of the materials charged to the mill and maintaining their concentrations in the proportions of step (b);

e. washing the portion removed in step (d) with solvent and separating the steel balls from the flake, lubricant and solvent, the washing with solvent providing the aluminum flake in a concentration in the range of 5 to 20 wt.%; and f. recirculating and feeding the steel balls to the mill at its entrance end.

13. An apparatus for forming metal particles into metal flake comprising:

a. a ball mill adapted to rotate about its longitudinal axis, said mill being substantially tubular in shape and having an entrance end and an exit end;

b. means for supplying metal particles, liquid and milling material to said mill at its entrance end;

c. a discharge scoop suitable for removing metal flake, liquid and milling material from said mill at a controlled rate, said scoop projecting into said mill at its exit end such that on rotation of said mill a portion of said metal flake, liquid and milling material can be removed by being directed into said scoop; and d. a spray means located within said scoop for washing said metal balls substantially free of said metal flake removed from said mill by said scoop.

14. The apparatus according to claim 13 wherein said milling material includes metal balls.

15. The apparatus according to claim 13 wherein said discharge scoop has a screen for separating said metal flake from said washed metal balls.

16. The apparatus according to claim 13 including means for returning said washed metal balls to said entrance end for recirculation through said mill.

17. An apparatus for forming metal flake from metal particles comprising:

a. a tubular shaped ball mill adapted to rotate about its longitudinal axis, said mill having an entrance end and an exit end;

b. means for supplying metal particles, liquid and metal balls to the mill at its entrance end at a controlled rate;

c. a discharge scoop for removing metal flake, liquid and metal balls from the mill at a controlled rate, said scoop projecting into the mill at its exit end such that on rotation of said mill a portion of the metal flake, liquid and metal balls can be removed by being directed into the scoop;

d. a spray means located within said scoop for washing said metal balls substantially free of said metal flake;

e. a screen provided in said scoop for separating the metal balls from the metal flake and liquid; and f. means for returning the metal balls separated from the metal flake to the entrance end for recirculation through the mill.

* * * * *